United States Patent [19]

Kosaka et al.

[11] 4,419,254

[45] Dec. 6, 1983

[54] METHOD OF PROTECTING SILVER CONTACTS

[75] Inventors: Shuhei Kosaka, Ota; Toshihiro Fujii, Ojima, both of Japan

[73] Assignee: Toshiba Silicones Limited, Waterford, N.Y.

[21] Appl. No.: 261,417

[22] Filed: May 7, 1981

[30] Foreign Application Priority Data

May 9, 1980 [JP] Japan ..... 55-61504

[51] Int. Cl.[3] ..... C10M 1/38; C10M 1/52

[52] U.S. Cl. ..... 252/37; 252/45; 252/46.3; 252/46.4; 252/49.6

[58] Field of Search ..... 252/37, 45, 46.4, 49.6, 252/46.3

[56] References Cited

U.S. PATENT DOCUMENTS

| | | | |
|---|---|---|---|
| 2,738,330 | 3/1956 | Hill | 252/45 |
| 2,941,945 | 6/1960 | Farnman et al. | 252/45 |
| 3,609,079 | 9/1971 | Devine et al. | 252/46.3 |

*Primary Examiner*—Jacqueline V. Howard

*Attorney, Agent, or Firm*—Gary L. Loser; Michael J. Doyle; John L. Young

[57] ABSTRACT

A method of protecting silver contacts in switches for electronic equipment is provided by utilizing a silicone-based grease which is comprised of a polyorganosiloxane base in combination with a thickener such as finely divided silica or a metal soap and an organomercaptan compound represented by $R^2SH$ wherein $R^2$ represents a saturated or unsaturated aliphatic hydrocarbon group having 18 to 22 carbon atoms. There may also be optionally included an ester bond-containing organic compound for improved properties when the treated silver contacts have relatively high contact pressure.

17 Claims, No Drawings

METHOD OF PROTECTING SILVER CONTACTS

This application claims priority under Japanese Patent Application 61504/80 filed May 9, 1980, by the present applicants.

FIELD OF THE INVENTION

The present invention relates to a method of protecting silver contacts in switches, tuners, electronic equipment and the like by utilizing a silicone-based grease.

BACKGROUND OF THE INVENTION

Mineral oil-based greases have been used for protection of contacts in electronic equipment. However, when a mineral oil-based grease is used, even if the plating state of the silver surface of a contact is improved, the contact resistance is unstable, and if the silver contact is formed of phosphor bronze or German silver as a contact base, there is the additional problem of insufficient sulfiding resistance.

Silicone greases are often used today to moderate these defects to some extent, but these improvements have heretofore been insufficient. Japanese Patent Publication No. 33254/76 proposes a silicone grease in which a fatty acid ester of a polyorganosiloxane and a mercaptan are incorporated so as to improve the sulfiding resistance and the stability of the contact resistance.

With the recent size reduction in television or audio apparatus, parts such as tuners and switches are often set in an atmosphere of a gas generated from the interior of a television or audio apparatus. The atmosphere may include, for example, ozone or a decomposition product of the plastic case or a gas introduced into the television or audio set from the outside (for example, $H_2S$, $SO_2$, HCl or a decomposition product of a frying oil). Silver contacts of a switch or tuner placed in such gas atmosphere are readily corroded and foreign substances readily adhere on the silver contacts thereby forming electrically insulated layers, with the result that the contact resistance becomes unstable. This in turn may cause such problems as flickering of television picture images and occurrence of switch noise.

It is therefore a primary object of the present invention to provide a method of protecting silver contacts from gases generated in electronic apparatus or which intrude into electronic apparatus.

SUMMARY OF THE INVENTION

More specifically, in accordance with one aspect of the present invention, there is provided a method of protecting silver contacts characterized by using as a contact-protecting agent a grease comprising (A) 100 parts by weight of a polyorganosiloxane represented by the following general formula:

$$[R_a^1SiO_{(4-a)/2}]_n$$

wherein $R^1$ is a monovalent group selected from the group consisting of an alkyl group having up to 3 carbon atoms, a phenyl group and a halogenated phenyl group, a is a number of from 1.9 to 2.7, and n is a positive number, (B) 0.01 to 50 parts by weight of a thickener and (C) 0.01 to 3 parts by weight of an organomercaptan represented by the following general formula:

$$R^2SH$$

wherein $R^2$ stands for a saturated or unsaturated aliphatic hydrocarbon having 18 to 22 carbon atoms.

Furthermore, in accordance with another aspect of the present invention, there is provided a method of protecting silver contacts characterized by using as a contact-protecting agent a grease comprising (A) 100 parts by weight of a polyorganosiloxane represented by the following general formula:

$$[R_a^1SIO_{(4-a)/2}]_n$$

wherein $R^1$ is a monovalent group selected from the group consisting of an alkyl group having up to 3 carbon atoms, a phenyl group and a halogenated phenyl group, a is a number of from 1.9 to 2.7, and n is a positive number, (B) 0.01 to 50 parts by weight of a thickener, (C) 0.01 to 3 parts by weight of an organomercaptan represented by the following general formula:

$$R^2SH$$

wherein $R^2$ stands for a saturated or unsaturated aliphatic hydrocarbon group having 18 to 22 carbon atoms, and (D) 0.1 to 50 parts by weight of an organic compound having an ester linkage.

DESCRIPTION OF THE INVENTION

The polyorganosiloxane (A) that is used as the main component of the grease in the present invention is ordinarily called a silicone fluid. The molecule of the polyorganosiloxane (A) is comprised mainly of diorganosiloxane units, and it may further comprise monoorganosiloxane units, $SiO_2$ units or the like. The polyorganosiloxane (A) is an oily substance in which the molecule is terminated by triorganosilyl groups. The organic group R′ bonded to silcone atom is as defined above, and may particularly include methyl, ethyl, propyl, phenyl and chlorinated phenyl groups. These $R^1$ groups may be the same or different. Furthermore, a mixture of silicone fluids represented by the above-mentioned general formula, differ in the kind of $R^1$ which may be used. In this general formula, n is a positive number, and it is preferred that n be a number satisfying the following requirement of the viscosity. It is preferred that such silicone fluid should have a viscosity of 10 to 100,000 centistokes (cSt) at a temperature of 25° C. If the viscosity is lower than 10 cSt, the volatility of the silicon fluid becomes too high and the grease tends to flow thereby causing problems, and if the viscosity exceeds 100,000 cSt, the viscosity resistance is increased and harmful effects are readily observed on the contact lubricating property.

In the present invention, the thickener (B) is used for imparting an appropriate consistency to the polyorganosiloxane (A). Among the suitable thickeners may be included finely divided silica, metal soaps, carbon, graphite, talc, organically modified bentonite, urea resins, fluorocarbon resins and molybdenum disulfide. It is indispensable that the thickener (B) should be used in an amount of 0.01 to 50 parts by weight per 100 parts by weight of the component (A). If the amount of the component (B) is smaller than 0.01 part by weight, an appropriate consistency is not obtained, and when the grease is coated on a contact, flow-out and phase separation are caused and good results are not obtained. If the amount of the component (B) exceeds 50 parts by weight, the flow becomes insufficient and the lubricating property is reduced, and again good results are not obtained. Among the foregoing thickeners finely divided silica and metal soaps are especially effective.

If the amount of finely divided silica is increased beyond an effective amount, the lubricating life of the composition may be drastically degraded. However, if the finely divided silica is incorporated in an appropriate amount, a stable contact resistance can be imparted even to a contact having low contact pressure. The particle size of the finely divided silica is in the range of from several millimicrons to several microns.

Furthermore, when the surface of the silver contact is chemically or physically degraded by contamination with a gas or by surface abrasion, the degraded surface is advantageously shaved off by the finely divided silica. It is ordinarily preferred that finely divided silica be used in an amount of 0.1 to 10 parts by weight.

The other preferred thickener (i.e. a metal soap), imparts the highest lubricating property to the silicone fluid among the various thickeners mentioned. Aluminum soap is most preferred among various metal soaps, because a most stable value of the contact resistance is given by aluminum soap. Finely divided silica and a metal soap may be used independently or in combination.

The component (C) used in the present invention is a saturated or unsaturated aliphatic mercaptan having 18 to 22 carbon atoms. Among the suitable organomercaptans there can be mentioned, for example, stearylmercaptan, isostearylmercaptan, oleylmercaptan, eicosylmercaptan and docosylmercaptan. If the carbon number is 16 or smaller, the sulfiding resistance is insufficient, and when the resulting grease is applied to a tuner, a switch or other electronic part used at a temperature of up to 70° C., the component (C) is evaporated with the lapse of time and the amount sufficient to impart a stable sulfiding resistance is not maintained. A saturated or unsaturated aliphatic mercaptan having 24 or more carbon atoms is poor in the compatibility with the polyorganosiloxane (A) and this mercaptan is difficult to disperse uniformly in the silicone grease. Furthermore, silicone grease using a higher aliphatic mercaptan having 24 or more carbon atoms tends to show a very unstable contact resistance. Accordingly, use of such higher aliphatic mercaptan is not preferred. An alkylmercaptan having an odd number of carbon atoms is difficult to obtain on an industrial scale. From the viewpoints of ease of industrial availability and ease of handling, stearylmercaptan is especially preferred. It is indispensable that such saturated or unsaturated aliphatic mercaptan (C) should be used in an amount of 0.01 to 3 parts by weight per 100 parts by weight of the component (A), but it is ordinarily preferred that the mercaptan (C) be used in an amount of 0.1 to 0.5 part by weight. If the amount of the mercaptan (C) is smaller than 0.01 part by weight, no substantial effect is attained by addition of the mercaptan (C). If the amount of the mercaptan (C) exceeds 3 parts by weight, the contact resistance of the silicone grease comprising such saturated or unsaturated aliphatic mercaptan becomes extremely unstable at a temperature lower than about 0° C. and abrasion of the silver contact becomes violent, often resulting in conduction failure.

The optional organic compound (D) having an ester bond that may be used in the present invention need not indispensably be used when the grease is applied to a silver contact of a low contact pressure. However, this component is especially effective when the grease is applied to a silver contact having a high contact pressure, and this component is an indispensable component in this aspect of the present invention. Even if this component is incorporated into a silicone grease to be applied to a silver contact of a low contact pressure of about 10 to about 20 g/cm$^2$, no substantial effect can be obtained, but if the grease is applied to a silver contact having higher contact pressure, contact resistance can be stabilized, the lubricating property will be improved, and the contact restoring property will be enhanced. Among the suitable organic compounds having an ester bond, there can be included, for example:

$(CH_2)_6(CH_2COOC_8H_{17})_2$, $C_6H_4(COOC_8H_{17})_2$, $(CH_2)_4(COOC_8H_{17})_2$, $C_6H_4(COOC_2H_5)_2$, $(CH_2)_4(COOC_{10}H_{21})_2$, and higher fatty acid esters of polyorganosiloxanes such as those represented by the following general formula:

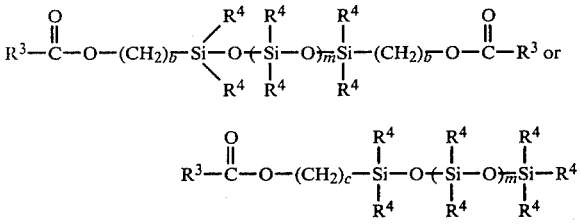

wherein $R^3$ stands for an alkyl or alkenyl group having 12 to 20 carbon atoms, $R^4$ stands for a monovalent hydrocarbon group or a monovalent halogenated hydrocarbon group, m is an average value of from 1 to 50, and b and c are, respectively, an integer of up to 3.

In order to stabilize the contact resistance, improve the lubricating property and enhance the restoring property on a silver contact having high contact pressure, the component should be incorporated in an amount of 0.1 to 50 parts by weight, preferably 5 to 30 parts by weight, per 100 parts by weight of the component (A). If the amount of the component (D) is smaller than 0.1 part by weight, no prominent effect is obtained in a switch or tuner of a high contact pressure. If the component (D) is incorporated in an amount exceeding 50 parts by weight, the stability of the silicone grease is degraded with the lapse of time, and the advantage of a broad application temperature range of the silicone grease, is lost. When a fatty acid ester of a polyorganosiloxane is used as the component (D), this component does not corrode plastics such as a polycarbonate or ABS resin used for switches or tuners, and therefore, especially good results are obtained.

When characteristic properties of the above-mentioned silicone grease for electric contacts were examined in application to television tuners or switches, it was found that this grease was advantageous over conventional greases for electric contacts, because the environmental resistance of silver contacts can effectively be improved without reduction of the stability of the electric contact resistance or the restoring property of contacts.

The present invention will now be described in detail with reference to the following Examples. In these Examples, all of parts are by weight, and values of the viscosity are those as determined at 25° C.

EXAMPLE 1

A polydiorganosiloxane shown in Table 1 was used as the base oil. Silicone greases 1 through 19 were prepared according to recipes shown in Table 2. Among them, greases 17 through 19 were comparative greases. The finely divided silica which was used was fumed silica having a specific surface area of 200 $m^2/g$, and which had been surface-treated with octamethylcyclotetrasiloxane. Each numerical value in the table indicates the amount (parts by weight). A stearic acid ester of polydimethylsiloxane which was used was a compound having a viscosity of 28 cSt and represented by the following molecular formula:

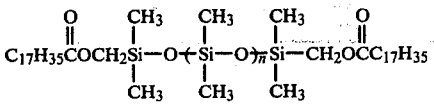

Each grease was coated on a silver contact (contact pressure = 150 $g/m^2$) of a television tuner, and 10,000 cycles of rotation were applied and the change of the contact resistance was examined. Furthermore, the coated contact was allowed to stand in dry air containing 1% of hydrogen sulfide for 24 hours, 7 days or 14 days, and the contact resistance value was measured. The results obtained are shown in Table 2.

TABLE 1

| Base Oil | Siloxane Units | Terminal Groups | Viscosity (cSt) |
|---|---|---|---|
| F-1 | dimethylsiloxy units 100% | trimethylsilyl groups | 5,000 |
| F-2 | diphenylsiloxy units 30% dimethylsiloxy units 70% | trimethylsilyl groups | 550 |
| F-3 | tetrachlorophenylsiloxy 5% units dimethylsiloxy units 95% | trimethylsilyl groups | 50 |

TABLE 2

| Components | Grease No. 1 | 2 | 3 | 4 | 5 | 6 | 7 | 8 | 9 | 10 |
|---|---|---|---|---|---|---|---|---|---|---|
| Base Oil F-1 | 100 | 100 | 100 | 100 | 100 | 100 | 100 | 100 | 100 | 100 |
| Base Oil F-2 | | | | | | | | | | |
| Base Oil F-3 | | | | | | | | | | |
| finely divided silica | 5 | 5 | 5 | 3 | 3 | | | | | |
| lithium stearate | | | | 5 | | 10 | | | | |
| aluminum stearate | | | | | 5 | | 10 | 10 | 10 | 40 |
| dodecylmercaptan | | | | | | | | | | |
| stearylmercaptan | 0.1 | 0.5 | 2.0 | 0.5 | 0.5 | 0.5 | 0.5 | 0.5 | 0.5 | 0.5 |
| oleylmercaptan | | | | | | | | | | |
| eicosylmercaptan | | | | | | | | | | |
| docosylmercaptan | | | | | | | | | | |
| tetracosylmercaptan | | | | | | | | | | |
| dioctyl sebacate | | | | | 5 | | | | | |
| stearic acid ester of polydimethylsiloxane | | | | | | | | | 10 | 10 |
| Viscosity (cp) of Grease | 17,000 | 17,200 | 17,500 | 34,000 | 32,000 | 27,000 | 25,400 | 27,200 | 14,300 | measurement impossible* |

| Components | Grease No. 11 | 12 | 13 | 14 | 15 | 16 | 17 (comparison) | 18 (comparison) | 19 (comparison) |
|---|---|---|---|---|---|---|---|---|---|
| Base Oil F-1 | 100 | | 50 | 50 | 50 | 50 | 50 | 50 | 50 |
| Base Oil F-2 | | 100 | | | | | | | |
| Base Oil F-3 | | | 50 | 50 | 50 | 50 | 50 | 50 | 50 |
| finely divided silica | 5 | 5 | 5 | 5 | 5 | 5 | 5 | 5 | 5 |
| lithium stearate | | | | | | | | | |
| aluminum stearate | | | | | | | | | |
| dodecylmercaptan | | | | | | | 0.5 | | |
| stearylmercaptan | 0.5 | 0.5 | 0.5 | | | | | | |
| oleylmercaptan | | | | 0.5 | | | | | |
| eicosylmercaptan | | | | | 0.5 | | | | |
| docosylmercaptan | | | | | | 0.5 | | | |
| tetracosylmercaptan | | | | | | | | 0.5 | |
| dioctyl sebacate | | | | | | | | | |
| stearic acid ester of polydimethylsiloxane | 10 | | | | | | | | |
| Viscosity (cp) of Grease | 18,000 | 16,500 | 18,300 | 18,100 | 21,200 | 28,300 | 18,300 | 50,800 | 17,800 |

| Components | Grease No. 1 | 2 | 3 | 4 | 5 | 6 | 7 | 8 | 9 | 10 |
|---|---|---|---|---|---|---|---|---|---|---|
| Contact Resistance (mΩ) | | | | | | | | | | |
| initial value | 2.3 | 2.6 | 18.3 | 16.1 | 2.4 | 18.1 | 3.1 | 2.9 | 3.2 | 12.8 |
| after 10,000 cycles of rotation | 17.2 | 16.8 | 3.6 | 18.2 | 9.1 | 22.6 | 14.2 | 5.6 | 6.8 | 19.4 |
| after 24 hours' dipping in 1% $H_2S$ | 3.2 | 2.9 | 19.5 | 16.8 | 3.1 | 19.3 | 4.8 | 3.2 | 2.9 | 11.5 |
| after 7 days' dipping in 1% $H_2S$ | 6.5 | 3.1 | 20.1 | 18.1 | 2.9 | 21.4 | 3.2 | 3.8 | 3.9 | 13.6 |
| after 14 days' dipping in 1% $H_2S$ | 13.8 | 3.5 | 20.5 | 17.4 | 3.4 | 23.8 | 5.1 | 3.6 | 4.4 | 13.9 |

| | Grease No. 17 (compar- | 18 (compar- | 19 (compar- |
|---|---|---|---|

TABLE 2-continued

| Components | 11 | 12 | 13 | 14 | 15 | 16 | ison) | ison) | ison) |
|---|---|---|---|---|---|---|---|---|---|
| Contact Resistance (mΩ) | | | | | | | | | |
| initial value | 2.9 | 8.2 | 2.8 | 2.9 | 5.9 | 8.3 | 1.9 | 39.2 | 1.8 |
| after 10,000 cycles of rotation | 8.1 | 14.5 | 16.1 | 13.8 | 14.2 | 15.6 | 9.1 | above 100 | 42.2 |
| after 24 hours' dipping in 1% $H_2S$ | 2.2 | 9.8 | 3.2 | 4.1 | 5.8 | 8.9 | 3.8 | 42.5 | 79.2 |
| after 7 days' dipping in 1% $H_2S$ | 2.5 | 11.2 | 3.2 | 4.9 | 5.1 | 10.3 | 54.0 | 48.3 | above 100 |
| after 14 days' dipping in 1% $H_2S$ | 3.1 | 14.7 | 3.6 | 3.7 | 5.3 | 9.2 | above 100 | 45.1 | above 100 |

Note
*worked penetration = 358

EXAMPLE 2

The silicone grease 7, 8, 9 or 11 used in Example 1 was coated on the same tuner as used in Example 1, and the rotation frequency was elevated to 20,000 times or 30,000 times and the contact resistance value was measured. The obtained results are shown in Table 3. The initial value and the value after 10,000 cycles of rotation were measured under the same conditions as in Example 1, and these values are compared with the values of Example 1 shown in Table 2.

TABLE 3

| Contact Resistance Milliohms | Grease No. 7 | 8 | 9 | 11 |
|---|---|---|---|---|
| Initial Value | 3.3 | 3.0 | 3.5 | 2.6 |
| After 10,000 Cycles of Rotation | 16.0 | 6.3 | 7.2 | 7.5 |
| After 20,000 Cycles of Rotation | 47.1 | 8.4 | 9.1 | 11.5 |
| After 30,000 Cycles of Rotation | 87.2 | 10.0 | 9.9 | 13.7 |

What is claimed is:

1. A method of protecting silver contacts comprising applying to said silver contacts a grease comprising:

(A) 100 parts by weight of a polyorganosiloxane represented by the general formula:

$$\left(R_a^1SiO_{\frac{(4-a)}{2}}\right)_n$$

wherein $R^1$ is a monovalent group selected from the group consisting of methyl, ethyl, propyl, phenyl and halogenated phenyl groups, a is a number from 1.9 to 2.7, and n is a positive integer;

(B) 0.01 to 50 parts by weight of a thickener; and (C) 0.01 to 3 parts by weight of an organomercaptan represented by the general formula:

$$R^2SH$$

wherein $R^2$ represents a saturated or unsaturated aliphatic hydrocarbon group having 18 to 22 carbon atoms.

2. A method according to claim 1, wherein the thickener (B) is selected from the group consisting of finely divided silica and metal soaps.

3. A method according to claim 1, wherein the thickener (B) is an aluminum soap.

4. A method according to claim 1, wherein the organomercaptan (C) is stearylmercaptan.

5. A method of protecting silver contacts comprising applying to said contacts a grease comprising:

(A) 100 parts by weight of a polyorganosiloxane represented by the general formula:

$$\left(R_a^1SiO_{\frac{(4-a)}{2}}\right)_n$$

wherein $R^1$ is a monovalent group selected from the group consisting of methyl, ethyl, propyl, phenyl and halogenated phenyl groups, a is a number from 1.9 to 2.7, and n is a positive integer;

(B) 0.01 to 50 parts by weight of a thickener;

(C) 0.01 to 3 parts by weight of an organomercaptan represented by the general formula:

$$R^2SH$$

wherein $R^2$ represents a saturated or unsaturated aliphatic hydrocarbon group having 18 to 22 carbon atoms; and (D) 0.1 to 50 parts by weight of an organic compound having an ester bond.

6. A method according to claim 5, wherein the thickener (B) is selected from the group consisting of finely divided silica and metal soaps.

7. A method according to claim 5, wherein the thickener (B) is an aluminum soap.

8. A method according to claim 5 or 7, wherein the organomercaptan (C) is stearylmercaptan.

9. A method according to claim 5, wherein the organic compound (D) is a fatty acid ester of a polyorganosiloxane.

10. A silicone grease comprising:

(A) 100 parts by weight of a polyorganosiloxane represented by the general formula:

$$\left(R_a^1SiO_{\frac{(4-a)}{2}}\right)_n$$

wherein $R^1$ is a monovalent group selected from the group consisting of methyl, ethyl, propyl, phenyl and halogenated phenyl groups, a is a number from 1.9 to 2.7, and n is a positive integer;

(B) 0.01 to 50 parts by weight of a thickener; and (C) 0.01 to 3 parts by weight of an organomercaptan represented by the general formula:

$$R^2SH$$

wherein $R^2$ represents a saturated or unsaturated aliphatic hydrocarbon group having 18 to 22 carbon atoms.

11. A composition according to claim 10, wherein the thickener (B) is selected from the group consisting of finely divided silica and metal soaps.

12. A composition according to claim 10, wherein the thickener (B) is an aluminum soap.

13. A composition according to claim 10, wherein the organomercaptan (C) is stearylmercaptan.

14. A composition according to claim 10, further comprising 0.1 to 50 parts by weight of (D) a fatty acid ester of a polyorganosiloxane.

15. A method according to claim 1, wherein the organomercaptan is present in the range of 0.1 to 0.5 parts by weight.

16. A method according to claim 5, wherein the organomercaptan is present in the range 0.1 to 0.5 parts by weight.

17. A composition according to claim 10, wherein the organomercaptan is present in the range 0.1 to 0.5 parts by weight.

* * * * *